United States Patent [19]

Ryon

[11] 4,085,645

[45] Apr. 25, 1978

[54] INSTANTLY RETUNABLE TONE GENERATOR FOR AN ELECTRONIC MUSICAL INSTRUMENT

[75] Inventor: Donald Carroll Ryon, Carol Stream, Ill.

[73] Assignee: Motorola, Inc., Schaumburg, Ill.

[21] Appl. No.: 736,985

[22] Filed: Oct. 29, 1976

[51] Int. Cl.[2] ..... G10H 5/06

[52] U.S. Cl. ..... 84/1.01; 84/1.23; 84/DIG. 11; 328/17

[58] Field of Search ..... 84/1.01, 1.03, 1.17, 84/1.22–1.24, DIG. 11; 328/17

[56] References Cited

U.S. PATENT DOCUMENTS

| | | | |
|---|---|---|---|
| 3,236,931 | 2/1966 | Freeman | 84/1.23 |
| 3,821,460 | 6/1974 | Maynard | 84/1.17 |
| 3,842,702 | 10/1974 | Tsundoo | 84/1.01 |
| 3,939,751 | 2/1976 | Harasek | 84/1.17 |
| 3,958,483 | 5/1976 | Borrevik et al. | 84/1.03 |

*Primary Examiner*—Stanley J. Witkowski
*Attorney, Agent, or Firm*—Margaret Marsh Parker; James W. Gillman

[57] ABSTRACT

DC programmable counters with DC switching provide instant retuning of an entire keyboard of a programmable electronic musical instrument to any one of a plurality of different scales.

8 Claims, 6 Drawing Figures

INSTANTLY RETUNABLE TONE GENERATOR FOR AN ELECTRONIC MUSICAL INSTRUMENT

BACKGROUND OF THE INVENTION

This invention relates to the field of programmable tone generators for keyboard musical instruments, and more particularly to the capability of instant switching of the program of the tone generator from one musical scale to another.

Programmable musical instruments such as those in U.S. Pat. Nos. 3,821,460 and 3,939,751, assigned to the assignee of the present invention, have been reprogrammed by manually resetting the appropriate switches in a bank of 120 switches per keyboard. While reprogramming a keyboard could be accomplished in a minute or less by a person skilled in the programming technique, it became apparent that it would be highly desirable to have instant retuning capability. Ideally, retuning should be accomplished by preset programming of a number of scales which would then be instantly available to a performer and which could be reprogrammed as desired. Further information regarding programmable musical instruments may be found in the above-mentioned patents.

SUMMARY OF THE INVENTION

It is, therefore, an object of the present invention to provide instant retuning capability for a programmable tone generator to one of a number of preset programs.

It is a particular object to provide such capability utilizing a minimum of components and cross wiring.

In a tone generator in accordance with the invention, the above objectives are achieved by the use of frequency dividing circuits having DC programmable counters and having only DC in the programmer switching circuits. Easily accessible to the user is manual switching capability for selecting one of a plurality of the predetermined programs. Gating circuits provide for programming of the signal circuits by DC and a diode/switch/resistor arrangement allows elimination of much of the switching and interwiring that would make the direct switching of so many signal circuits unfeasible.

DETAILED DESCRIPTION OF A PREFERRED EMBODIMENT

Figure 1:
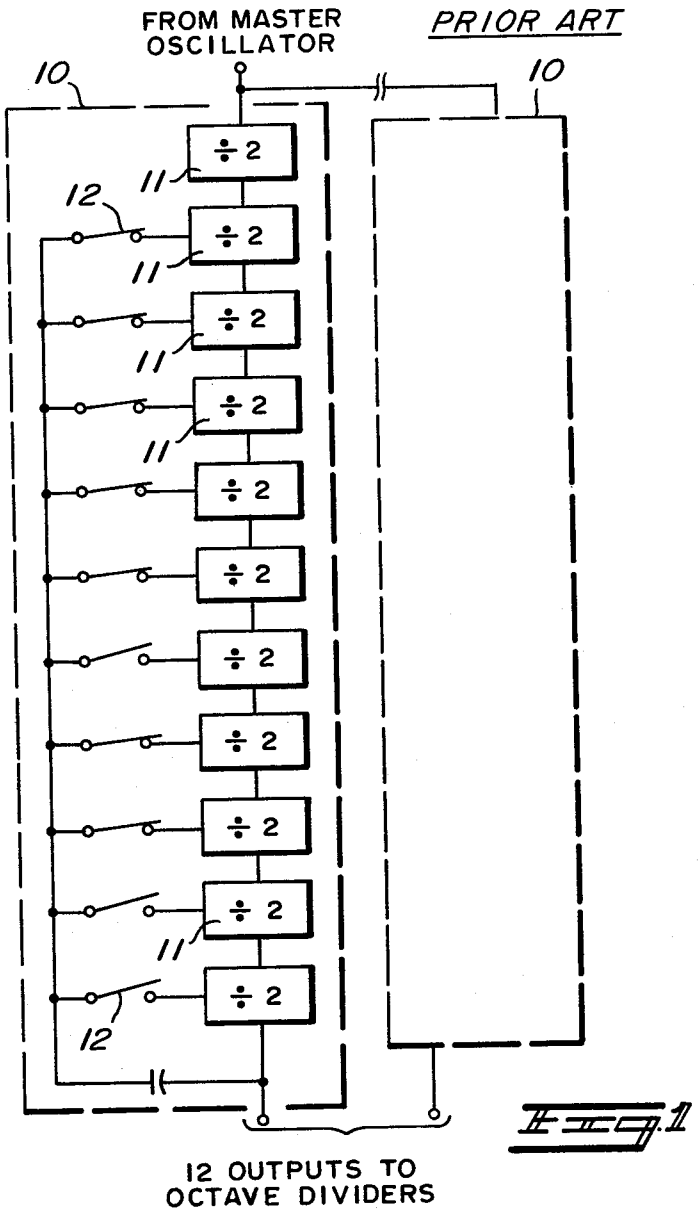
FIG. 1 is a block diagram showing a divider chain of the prior art.

A programmable divider/switching circuit 10 of the prior art is shown in FIG. 1, wherein a 3.58 MHz signal coming from a reference signal source or master oscillator is fed to a programmable divider including a ripple counter made up of eleven flip-flops 11. The output of the counter is fed back to ten of the flip-flops through individual programming switches 12. When all the switches are open, the signal from the oscillator is divided by $2^{11}$ or 2048. If, however, selected ones of the programming switches are closed, the divisor number is decreased and the output frequency is increased accordingly, over the range of approximately an octave. The twelve outputs of the programmable dividers 10 supply the frequencies for the top octave of the instrument keyboard. Octave dividers (÷2) provide suboctaves of those twelve frequencies for the remaining keys of the keyboard. Twelve programmable dividers are indicated in FIG. 1 since a divider is required for each key, i.e., C, C#, D, etc. of a programmable keyboard instrument in order to provide the capability for tuning the instrument to any twelve tone scale. That is, 120 switch positions determine a single scale. As mentioned above, complete information as to the programmable tone generator, its capabilities and advantages may be found in the referenced prior art patents.

This system is completely workable and commercially successful, and it can typically be retuned in a minute or less. However, it is often desirable to be able to switch instantaneously from one tuning to another without error, during a performance, perhaps during a single composition. To provide such capability with the system of the prior art would require an inordinate number of switch interconnections and interwiring, all carrying a signal of 3–4 MHz to the hundreds of switches. For aesthetic as well as practical reasons, it is preferable to have a scale selector switch on the console of the instrument and have most or all of the programmers remotely located.

Figure 2:
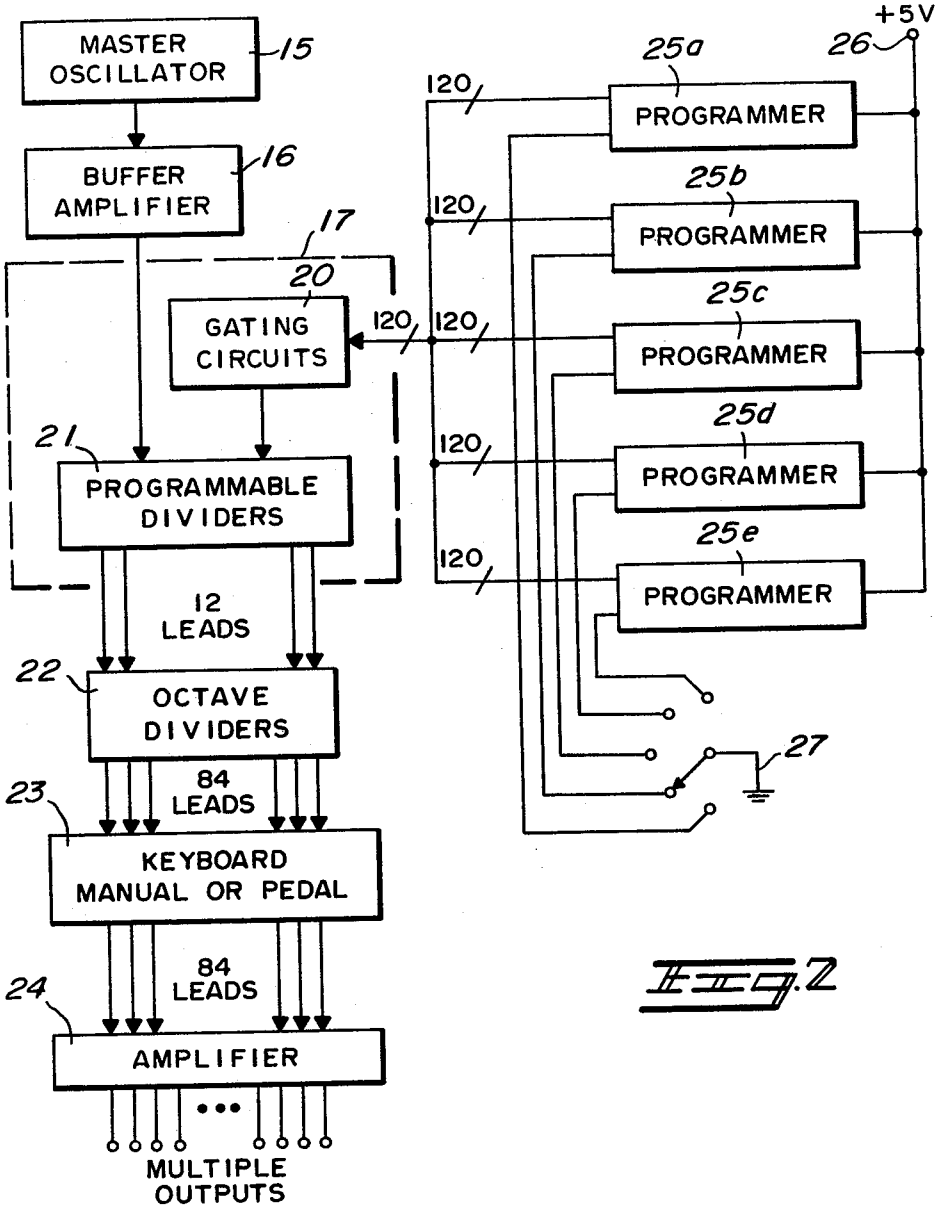
FIG. 2 is a block diagram of a system in accordance with the invention.

FIG. 2 shows in block form an entire instrument such as might embody the invention. A master oscillator 15 is coupled through a buffer amplifier 16 to a block (in dashed line) designated 17 which includes gating circuits 20 and programmable dividers 21. The block 17 is made up of twelve sections, one for each note of the scale, and each preferably including integrated circuit counters for embodying the gating and dividing functions. The counters are further described in relation to FIGS. 3, 4 and 5. As in the prior art, the twelve output signals of the dividers 21 are further divided by multiples of two in octave dividers 22 to provide the desired frequency signal for each key of the instrument keyboard 23. Those signals chosen by the performer via the manual or pedal keys are further processed in an amplifier 24 and fed to outputs such as speakers, headphones, etc. Connected to the gating circuit 20 is a cable of 120 wires coming from all of the remotely located programmers 25 a–e. All of the programmers are tied to a common +5V terminal 26 and, through a single pole-n position selector switch 27 ($n = 5$ in this example), to ground.

Figure 3:
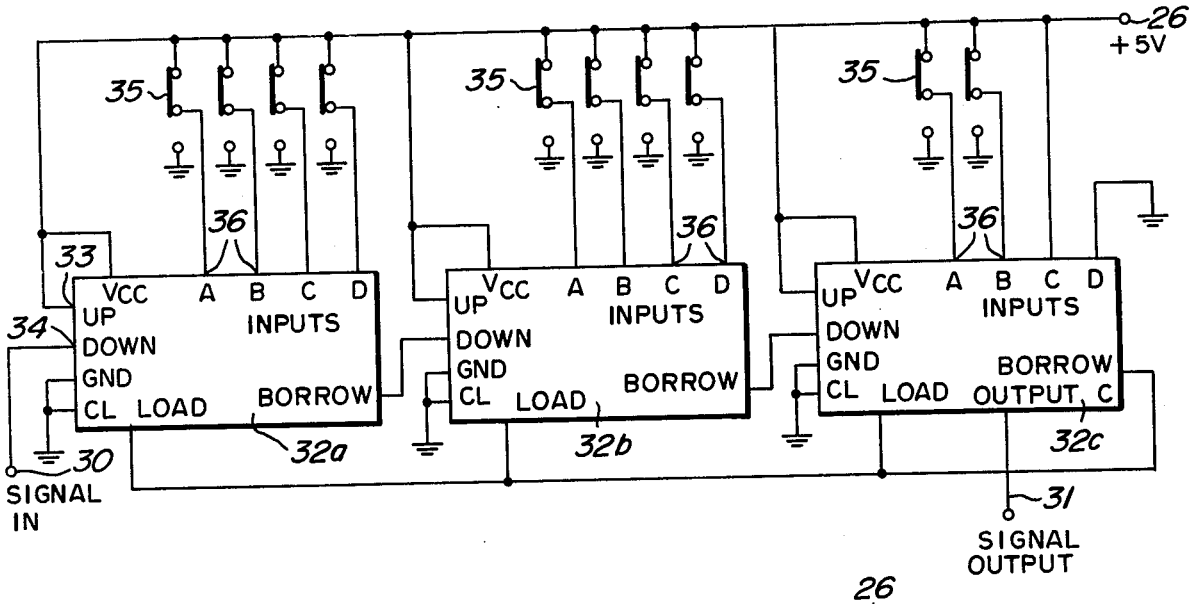
FIG. 3 is a simplified schematic diagram of a portion of the system of FIG. 2.

FIG. 3 shows a portion of the system of FIG. 2 in simplified form. A terminal 30, labelled "signal in", would couple to the buffer amplifier 16. A terminal 31, labelled "signal out" would couple to the octave divider 22. Three blocks 32a–c represent the gating and divider section for one scale note in the block 17. A comparable section would be included for each other note, normally a total of twelve notes per scale, though the invention is not limited to that number. Each of blocks 32a–c may be realized by a Synchronous Up/Down Counter with Dual Clock such as the Motorola MC74193, or an equivalent logic circuit, which is fully programmable and can be cascaded as shown. In this embodiment, the Count Up input 33 is held high and the input signal is coupled to the Count Down input 34. Ten switches 35 couple to ten of the Data Inputs 36, causing a "high" or "low" at each Data Input, and are represented in this figure as single-pole double-throw switches only for the purpose of simplifying the description at this point. As is known, with a given frequency signal "clocking" such a counter, the output frequency will depend on the high or low state of the data inputs. Since such counters are well known in the art, the other interconnections of the blocks 32a–c need not be further described with regard to this application.

A "top octave" frequency for each note of a given scale may thus be chosen at will by closing the appropriate switches, with the top octave frequency then being further divided in the octave divider 22 by means of divide-by-2 circuits, and tapped off for the individual key signals.

Figure 4:
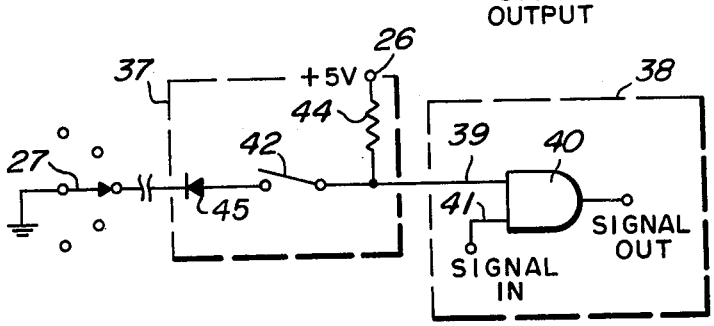
FIG. 4 is a schematic of a single gating circuit of the system of FIG. 2.
Figure 5:
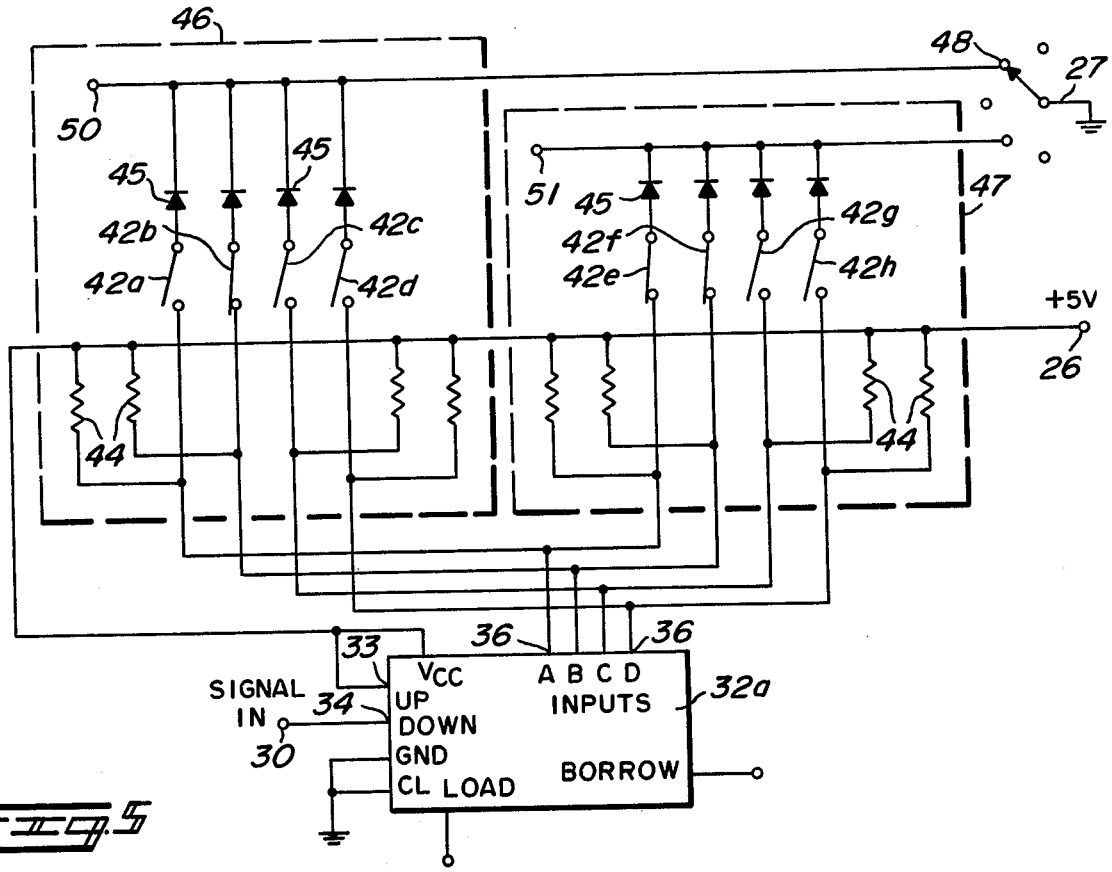
FIG. 5 is a schematic of portions of two programmers of the system of FIG. 2.

FIG. 4 shows a single switching circuit 37 of one of the programmers 25 with a portion 38 of the logic circuitry of one block 32 and the scale selector switch 27. The circuit 37 is the actual embodiment providing the switching function of the simplistic switch 35 of FIG. 3, i.e., circuit 37 and the connection through the selector switch 27 are the means of applying a high or low at one input 39 of an AND gate 40 in a data input circuit of the counter 32. If a a single pole, single-throw switch 42 in the switching circuit 37 is kept open as shown in FIG. 4, the input 39 will remain high, allowing each high of the input signal on an input 41 to be passed through the gate. Likewise, if the switch 42 is closed, the input 39 will be held low and no signals will pass through the gate. A resistor 44 has a value of the order of 47k ohms to limit the current flow in this circuit when the switch 42 is closed.

Within the single switching circuit shown in FIG. 4, the scale selector switch 27 and the switch 42 will have control and the diode 45 shown in the switching circuit would serve no purpose. However, in FIG. 5, the necessity for the diode 45 becomes apparent. As in FIG. 4, the signal input which is to be divided down is applied to the terminal 30 and coupled to the Down Count of the synchronous counter 32A. The section referenced as numeral 46 includes four of the ten switching circuits 37 for one note in the scale programmer 25 A. The section 47 has the corresponding four switching circuits for the same note in the programmer 25B. It will be seen that one of the switches 42A or 42E will control the data input A of the synchronous counter 32A, depending on the position of the scale selection switch 27. Likewise, the corresponding one of the switches 42B or 42F will control the data input B of the counter. A terminal 50 would couple to the remaining 116 switching circuits 37 associated with the four circuits 37 shown in the block 46. Similarly, a terminal 51 connects to the other switching circuits associated with those shown in block 47. In the example shown, the first scale program requires a high on data input A of the counter 32A and a low on input B, thus the switch 42A must be open and the switch 42B closed, whereas the second scale program requires a low on both inputs, thus switches 42E and 42F must be closed. However, it becomes apparent on tracing a current path from the scale switch contact 48 through switches 42B, 42F, 42E to data input A that, without the diodes 45 in the circuit, the input A would be low when it is required to be high.

Figure 6:
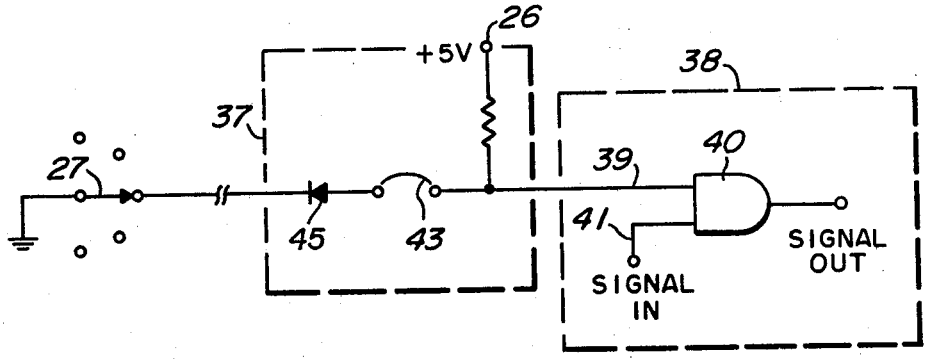
FIG. 6 is a schematic of another embodiment of the gating circuit of FIG. 4.

It is also to be noted that some or all of the programmers 25 with switches 42 as shown and described could alternatively have fixed or removable jumpers 43 in lieu of switches for permanent or semi-permanent scale tunings respectively as shown in FIG. 6. For example, the customary Equal Temperament tuning based on a 440 Hz pitch for the A above middle C would likely be pre-programmed permanently or semi-permanently. It should also be noted that the specific logic circuitry shown is exemplary only, and that, within the field of logic circuitry, equivalent embodiments falling within the scope of the appended claims are possible.

Thus there has been provided a system for instant scale changing capability in a pitch programmable electronic musical instrument, using DC programmable counters and diodes instead of a plurality of signal-carrying switches and cross wiring.

What is claimed is:

1. In a programmable tone generator for simultaneously providing a multiplicity of signal frequencies having a predetermined frequency relationship therebetween corresponding to one of a plurality of musical scales, a system for providing instant access to ones of a multiplicity of programs comprising:

a source of reference frequency;

DC programmable divider means coupled to the frequency source;

DC controlled switching means coupled to the divider means;

a source of DC potential for controlling said switching means;

a multiplicity of programming means coupled to the switching means for programming the divider means; and manual switching means for selectively coupling the source of DC potential to one of the programming means.

2. A system according to claim 1 wherein the DC programmable dividers and the DC controlled switching means comprise synchronous up/down counters.

3. A system according to claim 2 wherein the synchronous counters have multiple data inputs and the programming means comprises means for selectively coupling the source of DC potential to ones of the data inputs of the synchronous up/down counters.

4. A system according to claim 3 wherein the DC potential coupling means comprise single-pole single-throw switches.

5. A system according to claim 3 wherein the DC potential coupling means comprise removeably wired connections.

6. A system according to claim 3 wherein the DC potential coupling means comprise permanently wired connections.

7. A system according to claim 1 and further including octave divider means coupled to the programmable divider means for providing suboctaves of each divider output, amplifier means, output means coupled to the amplifier means, and means for selectively coupling desired outputs of the octave divider means to the amplifier means.

8. A system according to claim 7 wherein the output coupling means comprise keyboards.

* * * * *